US006626424B2

(12) United States Patent
Ngan et al.

(10) Patent No.: US 6,626,424 B2
(45) Date of Patent: Sep. 30, 2003

(54) QUENCH NOZZLE

(75) Inventors: Daniel Yuk-Kwan Ngan, Houston, TX (US); Louis Edward Stein, Houston, TX (US); Richard Addison Sanborn, Houston, TX (US); Raul Jasso Garcia, Sr., Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/123,716

(22) Filed: Apr. 16, 2002

(65) Prior Publication Data

US 2002/0109246 A1 Aug. 15, 2002

Related U.S. Application Data

(62) Division of application No. 09/275,846, filed on Mar. 24, 1999, now abandoned.

(51) Int. Cl.[7] ..... C10G 9/16

(52) U.S. Cl. ..... 261/112.1; 261/118; 261/DIG. 54; 208/48 Q

(58) Field of Search ..... 261/112.1, 118, 261/76, 79.2, DIG. 54; 422/194, 207; 208/48 Q

(56) References Cited

U.S. PATENT DOCUMENTS

| | | | | | |
|---|---|---|---|---|---|
| 2,754,340 | A | * | 7/1956 | Anderson, Jr. et al. | 208/62 |
| 2,775,629 | A | * | 12/1956 | Anderson, Jr. | 585/400 |
| 2,901,418 | A | * | 8/1959 | Pappas | 208/102 |
| 3,498,906 | A | * | 3/1970 | Bogart et al. | 208/50 |
| 3,514,264 | A | * | 5/1970 | Sennewald et al. | 422/193 |
| 3,544,086 | A | * | 12/1970 | Willett | 261/62 |
| 3,593,968 | A | * | 7/1971 | Geddes | 261/118 |
| 3,690,839 | A | * | 9/1972 | Jones | 422/207 |
| 3,878,088 | A | * | 4/1975 | Nahas et al. | 208/50 |
| 3,907,661 | A | * | 9/1975 | Gwyn et al. | 208/48 Q |
| 3,959,420 | A | * | 5/1976 | Geddes et al. | 261/112.1 |
| 4,107,226 | A | * | 8/1978 | Ennis et al. | 585/634 |
| 4,150,716 | A | * | 4/1979 | Ozaki et al. | 208/48 Q |
| 4,279,733 | A | | 7/1981 | Gwyn | 208/48 R |
| 4,279,734 | A | * | 7/1981 | Gwyn | 208/48 Q |
| 4,444,697 | A | * | 4/1984 | Gater et al. | 261/118 |
| 5,061,408 | A | * | 10/1991 | Huning et al. | 261/112.1 |
| 5,874,134 | A | * | 2/1999 | Rao et al. | 427/446 |
| 6,019,818 | A | * | 2/2000 | Knapp | 95/187 |

OTHER PUBLICATIONS

*Ethylene Production and Technology of Exxon*, Confidential Report, p. 45.

* cited by examiner

*Primary Examiner*—Frank M. Lawrence

(57) ABSTRACT

A quench nozzle design introduces quench oil tangentially into the quench tube which cools the hot gaseous pyrolysis products coming out of the hot radiant tubes in a pyrolysis furnace (in ethylene manufacture). Besides cooling the hot gases, the quench oil introduced into the quench tube by this nozzle design keeps the wall of the quench tube wetted, which is necessary to prevent coke deposition on the quench tube. The nozzle has one quench oil entry, which eliminates the need for any restriction orifice required to evenly distribute quench oil flows that would otherwise be required with several nozzle entries. Also, the one-nozzle oil introduction has a larger diameter than that required where more than one nozzle is employed in this service. The replacement of multiple nozzles with a single larger diameter nozzle eliminates plugging problems caused by coke solids or, coke solid precursors, present in the quench oil.

4 Claims, 3 Drawing Sheets

QUENCH NOZZLE

This application is a division of application Ser. No. 09/275,846, filed Mar. 24, 1999, now abandoned.

BACKGROUND OF THE INVENTION

1. Field of the Invention

The invention is generally directed to methods and apparatus for quenching a hot gaseous stream. The invention is more specifically directed to methods and apparatus for quenching the pyrolysis product from a pyrolysis furnace.

2. Description of Related Art

Assignee's olefins plant was the first gas oil steam cracker plant in which it was recognized that wetting of the quench tube wall is essential in order to keep the quench tube from fouling because of coke deposits. One of Assignee's designs, using a spray nozzle to introduce the quench oil for cooling the hot pyrolysis gas exiting the radiant section, did not work because of the difficulties in keeping the walls completely wetted. Previous nozzle configurations included an external quench ring encircling the quench tube for distributing quench oil between three nozzles arranged 120 degrees apart around the quench tube. This design created excessive thermal stress on the quench ring. Later, it was modified into three separate quench nozzles, all sharing one quench oil supply line, which required a flow restriction in each nozzle to ensure good distribution of quench oil.

The restriction orifices and smaller sized nozzles in the prior multi-nozzle oil injection quench tubes were frequently plugged by coke particles present in the quench oil. When this occurred, the quench oil flow wetting the quench tube wall was interrupted and this led to incomplete wetting of the quench tube wall. Coke would form and grow on the dry spot of the quench tube wall and would eventually plug the quench tube. When this occurred, the entire furnace had to be shutdown for cleaning. Even without problems with the injection nozzles, the quench tube was subject to coke formation and plugging at the moving boundary between wetted and dry walls near the oil inlets.

SUMMARY OF THE INVENTION

A quench nozzle design introduces quench oil tangentially into the quench tube and cools the hot gaseous pyrolysis products coming out of the hot radiant tubes in a pyrolysis furnace (e.g., in ethylene manufacture). Besides cooling the hot gases, the quench oil introduced into the quench tube by this nozzle design keeps the wall of the quench tube wetted, which is necessary to prevent coke deposition on the quench tube. The nozzle has one quench oil entry, thus eliminating the need for any restriction orifice which would be required to evenly distribute quench oil flows between several nozzles. Also, the one-nozzle oil introduction has a larger diameter than that required if more than one nozzle were employed in this service. The replacement of multiple nozzles (and restriction orifices) with a single larger diameter nozzle eliminates plugging problems caused by coke particles present in the quench oil. The quench tube walls are maintained wetted by the use of an internal ring with a specially-tapered leading edge and an abrupt terminal end which serves to prevent the quench oil/gas interface from moving axially back and forth in the quench tube, and thereby eliminating coke formation.

DESCRIPTION OF THE PREFERRED EMBODIMENTS

Figure 1:
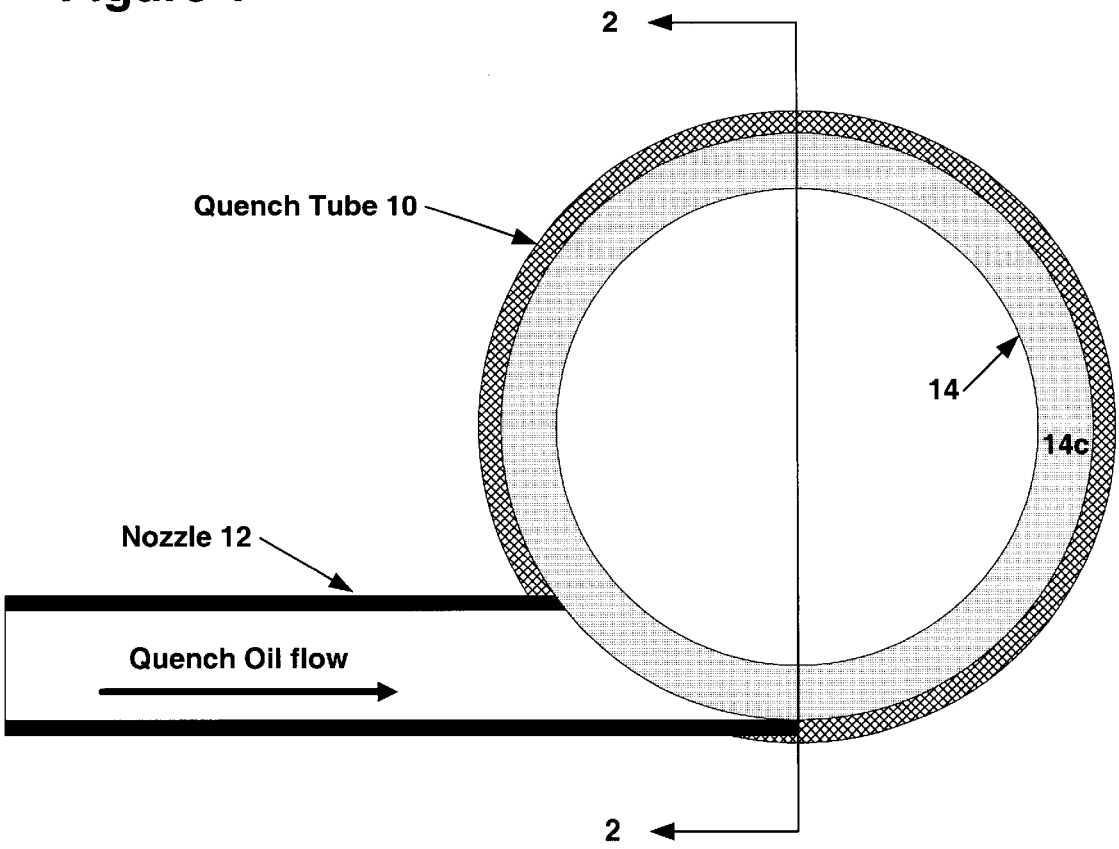
FIG. 1 is a cross section view of the quench tube and nozzle of the instant invention.

The environment of the invention is a pyrolysis furnace as disclosed in FIG. 1 of Assignee's U.S. Pat. No. 3,907,661 which patent is incorporated herein by reference. Applicants' invention is an improvement in the design of the quench zone of that patent or in other similar apparatus.

Figure 2:
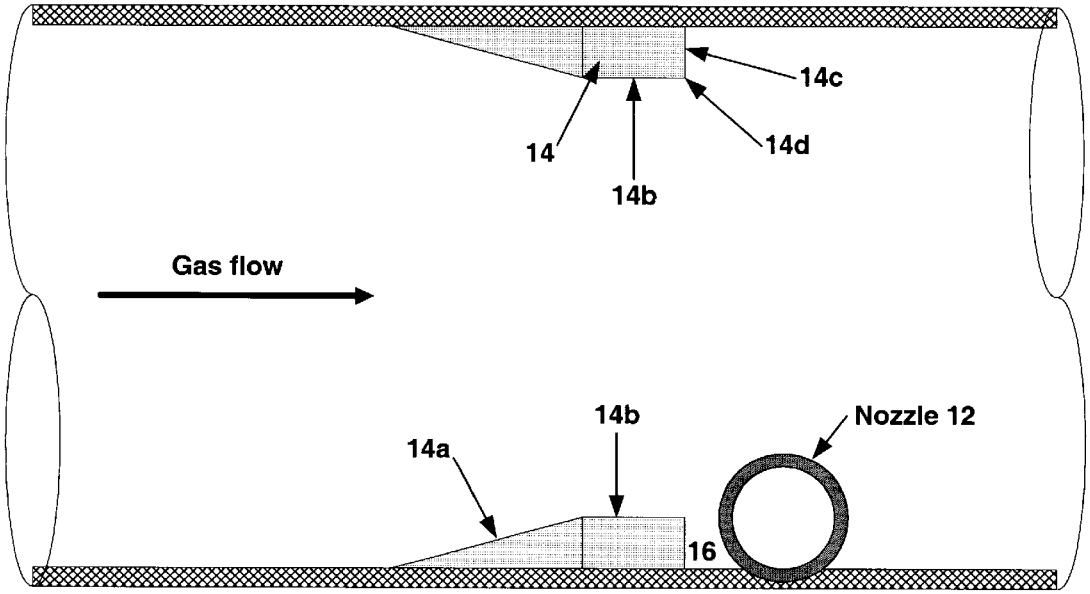
FIG. 2 is a cross section view taken along the line 2—2 of FIG. 1.

Referring now to FIG. 1 of the instant application, quench tube 10 is shown in cross section and having a quench oil inlet tube or nozzle 12 which forms an entry into quench tube 10 on a tangent thereto. FIG. 1 is taken on a diameter of nozzle 12 and of quench tube 10 where the two conduits intersect and the combination as described herein comprises an improvement to the quench zone of the '661 patent. FIG. 2 shows a cross section of quench tube 10 taken along the longitudinal axis thereof and looking back into the nozzle 12. Within quench tube 10 and upstream of nozzle 12 (relative to gas flow and corresponding to the input to the quench zone in FIG. 1 of the '661 patent) is an insertion ring 14 having a ramp portion 14*a* terminating in a flat section 14*b*, the latter having a sharp interface with face 14*c*. That is, flat section 14*b* and face 14*c* of insertion ring 14 intersect at a right angle to form a sharp edge 14*d*. The function of the insertion ring 14 and variations thereof is to form a low-pressure zone 16 at the downstream face 14*c*.

Nozzle 12, in its simplest form, may be a constant-diameter pipe which enters quench tube 10, preferably at a right angle and with one of its walls on a tangent to the quench tube 10. An insertion ring 14 is located a short distance upstream of nozzle 12 and creates a low-pressure zone 16 at face 14*c*. The optimum distance between face 14*c* and nozzle 12 is the distance that results in no liquid flowing over the sharp edge 14*d* but which completely wets face 14*c*. The quench oil injected by nozzle 12 flows circumferentially around the inner surface of quench tube 10 (because of the tangential injection at sufficient pressure) filling the low-pressure zone 16 at to the face 14*c*. In order for the invention to function properly, it is necessary that the liquid being injected tangentially through nozzle 12 have sufficient velocity so that the applied centrifugal force acting on this incoming stream for the duration of the fluid's first revolution within quench tube 10 exceeds that acting on the incoming stream which is due to the gravitational field in effect in this region of the apparatus. In other words, this velocity must be such that $$U^2/(Rg)>1 \text{ where:} \quad (1)$$

$U^2$ is the square of the inlet velocity,

R is the inside radius of quench tube 10, and g is the acceleration of gravity, all expressed in a consistent set of dimensional units Typical values of $U^2/(Rg)$ range between 3 and 20. The quench oil is then spread along the inner wall of the quench tube 10 as a result of fluid drag forces acting on the oil by the gas phase. This interaction between the gas and oil phases also results in some transfer of momentum in the downstream direction from the gas to the quench oil. In this manner, face 14*c* and the inner wall of the quench tube 10 downstream thereof, are maintained in a "wet" condition, thereby creating a two-phase annular flow regime which inhibits the formation of coke. The portion of quench tube 10 upstream of face 14*c*, including surfaces 14*a* and 14*b* of insertion ring 14, remain "dry" and are, therefore, not subject to coke formation. The sharp edge, 14*d* of insertion ring 14, forms the abrupt interface between "wet" and "dry" sections.

Figure 3:
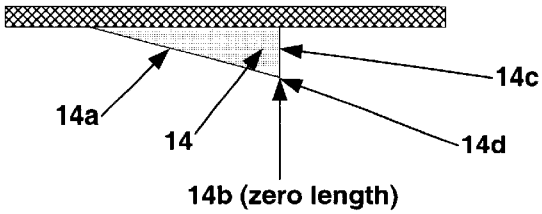
FIGS. 3–10 show various embodiments of several permutations of the insertion ring.
Figure 4:
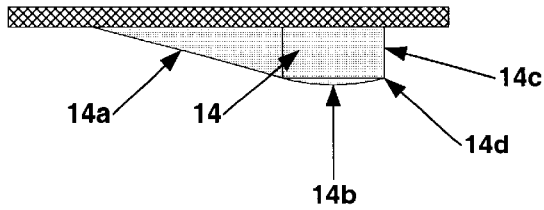
Figure 5:
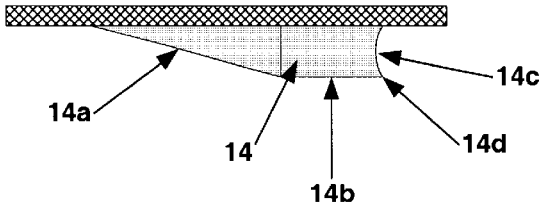
Figure 6:
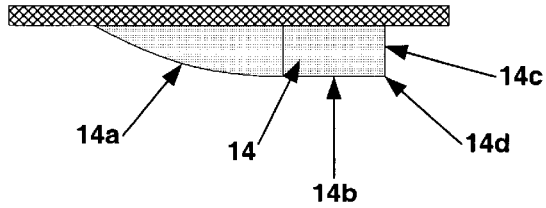
Figure 7:
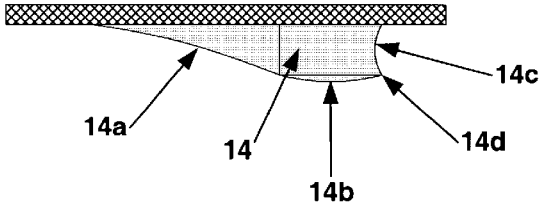
Figure 8:
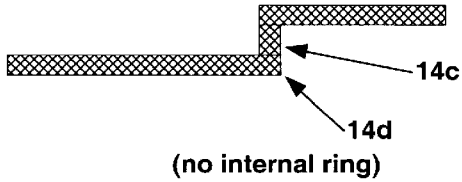
Figure 9:
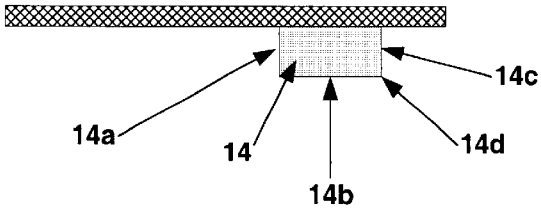
Figure 10:
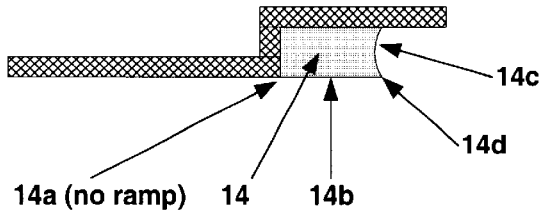

Insertion ring 14 has been described herein as having flat sections (14*a*, 14*b* and 14*c*) but could also be constructed with curved, extended or shortened sections. The critical features required to be maintained are the sharp interface 14*d* and the low-pressure zone 16. FIGS. 3 through 10 illustrate a portion of other combinations for insertion ring 14. FIG. 3 utilizes a zero length flat section 14*b*, i.e., a ramp 14*a* terminating in a sharp interface 14*d* with face 14*c*. FIG. 4 shows a curvature in the section 14*b* that is generally parallel with the axis of the quench tube. FIG. 5 utilizes a concave section 14*c* to contain the low-pressure zone and alter the angle of the sharp edge, 14*d*. FIG. 6 illustrates an altered shape of the ramp portion, 14*a*. FIG. 7 shows one embodiment of combinations of modifications that maintain the "wet/dry" interface and the low-pressure zone. FIG. 8 is another combination utilizing an "infinite" ramp length, i.e., no internal insertion ring 14*a*. It is, essentially, a demonstration of how two quench tubes of different diameters may perform the function of insertion ring 14. FIG. 9 shows an insertion ring 14 having 90-degree faces 14*a* and 14*c*. This configuration causes excessive leading edge (of insertion ring) turbulence and resultant pressure drop, but could be used in some applications. FIG. 10 is an embodiment of FIG. 8 that may be easier to fabricate. It is shown with a concave face 14*c*, although convex or flat surfaces may also be utilized.

Although the nozzle 12 is described herein in terms of a tube or conduit (cylindrical) element, it could be of other shapes in cross section, i.e., elliptical, square, rectangular, etc. The critical features of the design are the utilization of a tangential, or approximately tangential, inlet tube to impart a velocity to the oil of sufficient momentum to cause the oil to flow around the circumference of the quench tube 10 while completely wetting the face 14*c*. Likewise, although only one nozzle is described, plural nozzles could be used, e.g., two nozzles diametrically opposed on quench tube 10 so as to aid each other in circumferentially flowing the quench oil. Also, the tangential entry is preferably at a right angle to the quench tube 10 whereas any angle may be employed as long as the oil will fill the low-pressure zone 16 around the circumference of the quench tube 10 next to the face 14*c*. Similarly, the distance of the outside surface of nozzle 12 from face 14*c* is determined by the need to have the oil pulled and spread into the low-pressure zone 16 without overflowing the sharp edge 14*d*. In the preferred embodiment of the invention, this distance should lie between about 20% and 100% of the inside diameter of nozzle 12.

Insertion ring 14 may be fabricated as a ring that is welded inside quench tube 10, or it may be fabricated as an integral portion of the quench tube. Insertion ring 14, as illustrated in FIG. 1, includes a ramp portion 14*a* that is preferably about 7½ degrees but may be inclined to 90 degrees, or more, maximum grade. The ramp, 14*a*, may be as little as zero degrees in the case of two separate quench tube diameters (FIG. 8). The ramp portion 14*a* terminates in a flat or curved portion 14*b* which, in turn, terminates in a sharp edge, or interface 14*d*, with face 14*c*. Under gas flow conditions, the insertion ring 14 restricts the flow area causing the gas velocity to increase as it flows through the insertion ring. A low-pressure zone 16 is created by this increased velocity which tends to pull the tangentially injected quench oil from nozzle 12 into the low-pressure zone 16 thereby wetting the quench tube inner wall and insertion ring surface 14*c* in this area. The quench oil from nozzle 12 is then conveyed downstream by the furnace gas flow and is maintained against (thereby wetting) the quench tube 10 wall. The length of the ramp 14*a* is preferably as long as possible so as to cause the least turbulence; however, manufacturing (machining) limitations control the physical dimensions which are possible.

Although the orientation of the quench tube 10 is shown as being horizontal, as long as the combined momentum of the quench oil and gas flow can maintain the quench wall wetted, the orientation of the quench tube 10 can be vertical or at an angle to the horizontal position, upflow or downflow. The lines should be sized and oriented, and the gas and liquid flow rates should be such as to produce and maintain two-phase annular flow within the quench tube 10 downstream of face 14*c* in order to accomplish the wall wetting function.

Although the invention has been described herein with reference to a specific application in pyrolysis furnaces, other applications are possible such as:

1. The injection of a "wash-water" stream into a pipe carrying a gaseous stream in order to wet the downstream piping walls to prevent or remove salt deposits in process water-wash operations (e.g., hydrocracker water-wash operations).
2. The injection of a water or hydrocarbon-based corrosion inhibitor into a pipe bearing a gaseous stream in order to uniformly wet the downstream piping walls for corrosion control. (e.g., the injection of a filming amine into the overhead line of an absorption or distillation column).
3. The injection of a hydrocarbon or water-based liquid into a pipe bearing a gaseous stream in order to prevent the downstream pipe walls from becoming excessively hot (e.g., injection of "spray" or quench water into catalytic cracking or fluid coking overhead lines in order to keep pipe temperatures below their metallurgical operating limits).
4. The wetted-wall tangential quench tube configuration can be applied to the individual tube in the Transfer Line Exchanger (TLE) at the outlet of pyrolysis furnaces. TLE's are shell-and-tube heat exchangers where the hot pyrolysis gaseous products exiting the radiant tube are indirectly cooled or quenched on the tube side while generating high-pressure steam on the shell side. Coke will deposit on the tube side, thereby reducing heat transfer, increasing pressure drop across the TIE and requiring periodic decoking and furnace downtime. By applying the wetted wall quench technology (method) disclosed herein to completely wet the inside of these TLE tubes, coking can be prevented, thus reducing the attendant downtime and production loss.

EXAMPLE

Furnaces in one of Assignee's plants utilizing the old quench nozzle design typically have to be shut down every fifteen days due to quench nozzle plugging in one or more of the ten quench passes in each furnace. In Assignee's test installation to prove the concept of the invention disclosed herein, the quench pass (with the old nozzle design) that was most prone to a plugging problem in the most frequently plugged furnace was selected for replacement. That nozzle was replaced by a quench tube 10 which utilized a Schedule

40 pipe having a nominal 8-inch diameter and was intersected by a nozzle 12 having a 1½ inch I.D. bore. The quench liquid was injected at a flow rate of about 13 ft/sec (74 gal/min) into the hot gas stream flowing at about 200–250 ft/sec. The test quench pass nozzle system was operated for about one year with no downtime or plugging even though other nozzles (with the old design), including those adjacent to the test nozzle in the same test furnace, did plug due to coking, thus requiring ant shutdown of the whole test furnace. This demonstrated the resistance of the new nozzle design to plugging in a plugging-prone environment as shown by the continuing plugging problems experienced by the other "old design" nozzles in the same furnace.

What is claimed is:

1. A method for quenching a hot gas stream flowing in a conduit, comprising the steps of:

conveying said hot gas stream through said conduit from an upstream source to a downstream location;

inserting flow obstruction means within said conduit;

injecting a quenching fluid tangentially into said hot gas stream at a momentum sufficient to cause said quenching fluid to flow circumferentially around the entire inside surface of said conduit;

providing a sharp interface between said hot gas stream and said quenching fluid;

creating a low-pressure zone in said hot gas stream immediately downstream of said flow obstruction means;

filling said low-pressure zone of said hot gas stream with said quenching fluid; and causing said quenching fluid to contact and wet the downstream face of said flow obstruction means.

2. The method of claim 1 wherein said quenching fluid is injected downstream of said flow obstruction means.

3. The method of claim 1 wherein said quenching fluid is injected at substantially a right angle to said hot gas stream.

4. The method of claim 1 wherein said quenching fluid is injected so as to provide a momentum according to the equation $U^2/(Rg)>1$ where:

$U^2$ is the square of the inlet velocity,

R is the inside radius of quench tube 10, and g is the acceleration of gravity.

* * * * *